US006749549B1

(12) United States Patent
Chu

(10) Patent No.: US 6,749,549 B1
(45) Date of Patent: Jun. 15, 2004

(54) QUICKLY COLLAPSIBLE AND ERECTABLE HORIZONTAL AND PARALLEL BARS COMBINATION

(76) Inventor: Walt Chu, 7F, No. 29-3, Sec. 4, Jen-Ai Rd., Taipei (TW)

( * ) Notice: Subject to any disclaimer, the term of this patent is extended or adjusted under 35 U.S.C. 154(b) by 0 days.

(21) Appl. No.: 10/409,169

(22) Filed: Apr. 9, 2003

(51) Int. Cl.[7] ..... A63B 71/00

(52) U.S. Cl. ..... 482/148; 482/907; 482/35; 482/38

(58) Field of Search ..... 482/148, 907, 482/35–38; 182/179.1, 141, 129, 152, 187, 20, 222; D25/162, 68; 248/235

(56) References Cited

U.S. PATENT DOCUMENTS 3,601,397 A * 8/1971 Carlin ..... 272/565 R
6,394,932 B1 * 5/2002 Chu ..... 482/38
6,413,198 B1 * 7/2002 Gray ..... 482/148

* cited by examiner

*Primary Examiner*—Nicholas D. Lucchesi
*Assistant Examiner*—L Amerson

(57) ABSTRACT

A quickly collapsible and erectable horizontal and parallel bars combination mainly includes two modularized upright assemblies, two side supports detachably connected to a top of the upright assemblies, and a top bar detachably supported on and between upper ends of the two side supports. Each of the upright assemblies includes two upright posts, upper and lower crossbars fixedly connected to predetermined positions on the two upright posts, a U-shaped handgrip and a framed foot member pivotally connected to the upper and the lower crossbar, respectively, and supporting posts vertically connected to and extended between the handgrip and the framed foot member. The handgrip and the framed foot member may be synchronously pivotally turned upward to collapse the upright assembly to an almost flat state and accordingly a largely reduce volume.

6 Claims, 3 Drawing Sheets

QUICKLY COLLAPSIBLE AND ERECTABLE HORIZONTAL AND PARALLEL BARS COMBINATION

FIELD OF THE INVENTION

The present invention relates to a quickly collapsible and erectable horizontal and parallel bars combination, and more particularly to a horizontal and parallel bars combination including two modularized upright assemblies that could be quickly detached from other structural members of the combination and collapsed into a flat state occupying a largely reduced space.

BACKGROUND OF THE INVENTION

A conventional horizontal bar generally includes two simple upright posts and a top bar transversely supported on upper ends of the upright posts. To ensure the structural strength and stability of the conventional horizontal bar, the two upright posts are usually buried into the ground by a predetermined depth, and the top bar is welded to the upper ends of the upright posts. On the other hand, conventional parallel bars mainly include a plurality of supporting posts and two parallel bars are horizontally supported on upper ends of the supporting posts. As the above-described conventional horizontal bar, the conventional parallel bars have the drawback of being fixedly erected and not easily movable, and are therefore not convenient for use. Moreover, the conventional horizontal bar and parallel bars are actually structurally similar to one another in many aspects. However, there has not been any design integrating these two items into one unit up to date.

In view of the above many disadvantages found in the conventional horizontal bar and parallel bars, such as being unmovable, non-collapsible, occupying a large space, etc., the same inventor of the present invention has previously developed a sectional horizontal bar and parallel bars combination that is granted a U.S. Pat. No. 6,394,932. The sectional horizontal and parallel bars combination disclosed in U.S. Pat. No. 6,394,932 mainly includes two side supports, two top carriers connected to the top of the two side supports, and a top bar supported on upper ends of the two top carriers. The top bar forms a main structural member of a general horizontal bar. Two curved braces are separately pivotally connected at two ends to predetermined positions on the two side supports. When the curved braces are pivotally turned toward each other to horizontally extend below the top bar, a user may grip at the curved braces to do simple parallel bar exercises. Two U-shaped tubes are separately connected to front and rear sides of the two side supports to horizontally project therefrom to increase a contacting area between the sectional horizontal and parallel bars combination and the ground. With the above arrangements, the sectional horizontal and parallel bars combination disclosed in U.S. Pat. No. 6,394,932 could be conveniently disassembled and moved, and functions as horizontal bar and parallel bars at the same time.

A disadvantage of the above-mentioned sectional horizontal and parallel bars combination of prior art is it takes a lot of time to assemble and disassemble the structural members thereof. It is therefore tried by the inventor to develop an improved sectional horizontal and parallel bars combination having a modularized design to enable easier erection and collapse and accordingly convenient use thereof.

SUMMARY OF THE INVENTION

A primary object of the present invention is to provide a quickly collapsible and erectable horizontal and parallel bars combination including modularized upright assemblies, each of which can be quickly collapsed into a volume-reduced flat state for easy packing and/or storage or quickly erected for use simply by pivotally turning a handgrip and a framed foot member upward or downward.

Another object of the present invention is to provide a quickly collapsible and erectable horizontal and parallel bars combination including two upright assemblies, two side supports separately connected to upper ends of the two upright assemblies, a top bar transversely supported on tops of the two side supports. Each of the upright assemblies includes two upright posts and two crossbars fixedly assembled into a frame, a U-shaped handgrip and a framed foot member pivotally connected to upper and lower ends, respectively, of the two upright posts, and a plurality of supporting posts vertically extended between and thereby indirectly connecting the handgrip and the foot member. Thus, the upright assembly is modularized and the handgrip and the foot member can be pivotally turned upward synchronously to collapse the upright assembly into a flat state.

A further object of the present invention is to provide a quickly collapsible and erectable horizontal and parallel bars combination including two upright assemblies, each of which includes two auxiliary struts pivotally connected at an end to predetermined positions on two upright posts of the upright assembly for the latter to stand stably in an erected state, and a secondary crossbar transversely extended between the two upright posts at a predetermined height. The secondary crossbar is provided at two opposite sides near two outer ends with two receiving brackets for holding free ends of the two auxiliary struts thereto when the latter are pivotally turned during collapsing of the upright assembly.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
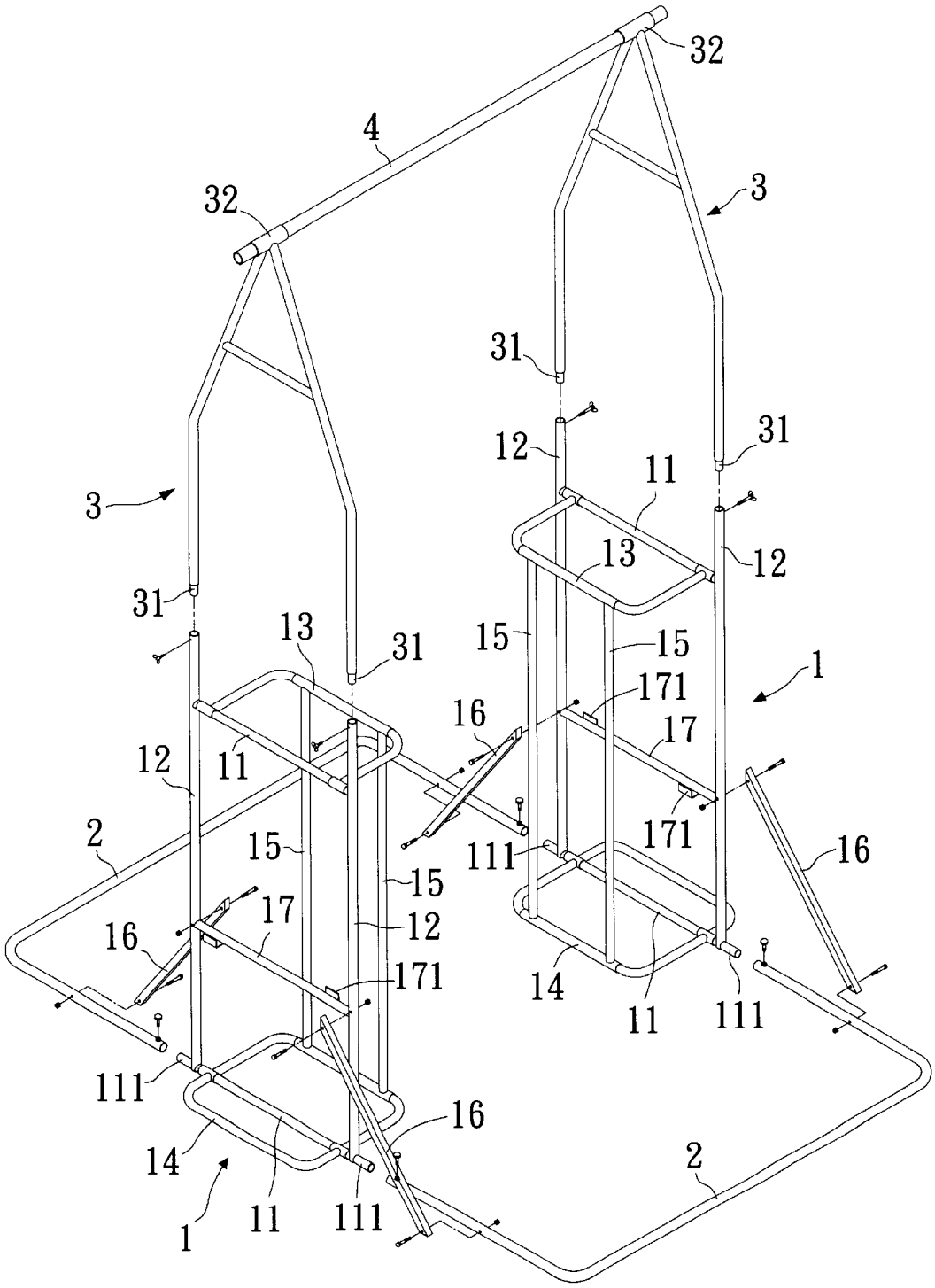
FIG. 1 is an exploded perspective view of the present invention.
Figure 2:
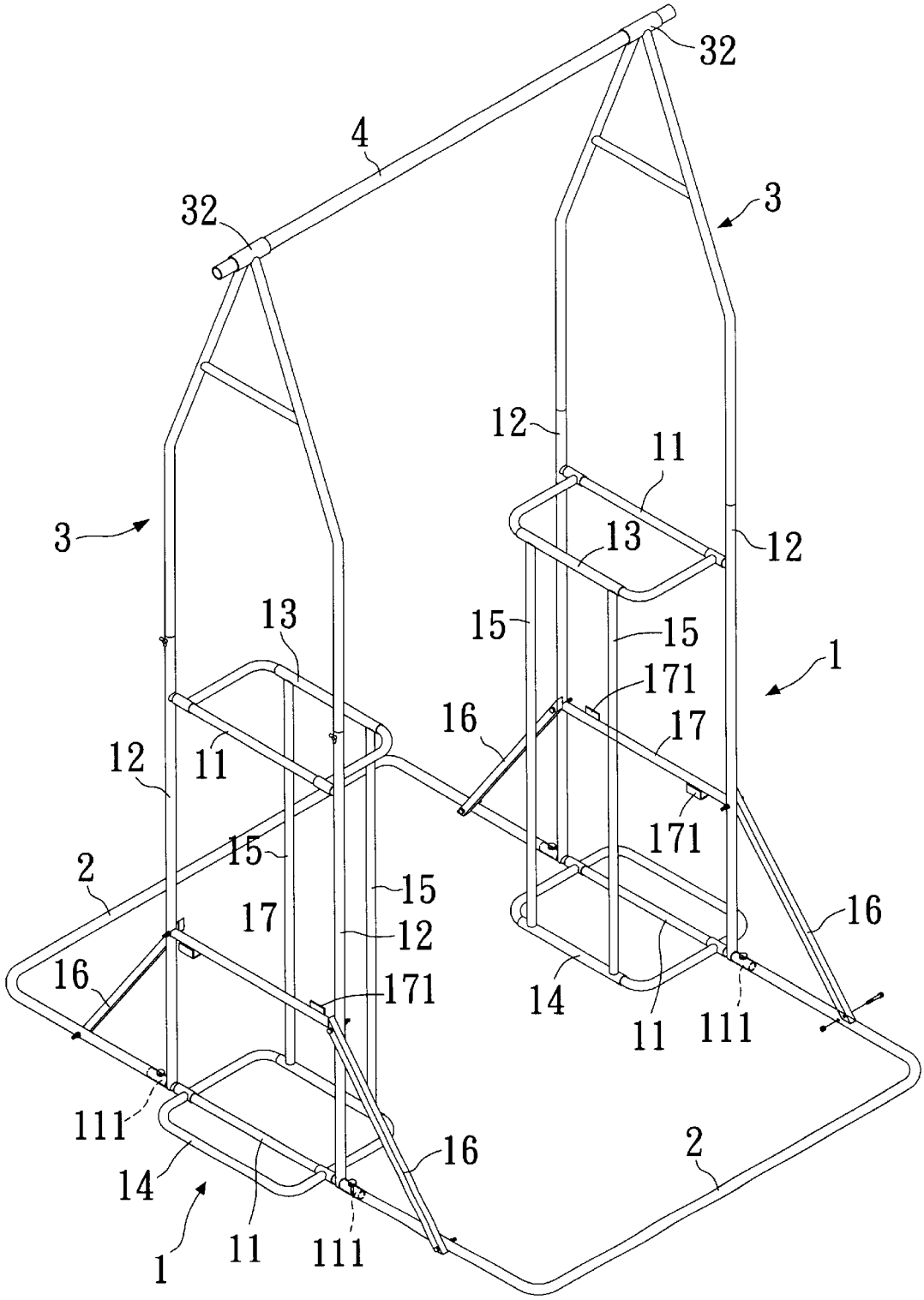
FIG. 2 is an assembled perspective view of FIG. 1.

Please refer to FIGS. 1 and 2 that are exploded and assembled perspective views, respectively, of a quickly collapsible and erectable horizontal and parallel bars combination according to an embodiment of the present invention. As shown, the present invention mainly includes two upright assemblies 1, two U-shaped tubular bases 2, two side supports 3, and a top bar 4. Each of the two side supports 3 is a substantially A-shaped frame having two parted lower posts with reduced insertion heads 31 formed at lower ends thereof, and a joined top having a locating sleeve 32 transversely connected thereto. The top bar 4 has two outer ends extended through the two locating sleeves 32 and is thereby transversely supported on and between the two side supports 3.

Each of the two upright assemblies 1 includes two crossbars 11, two upright posts 12, a U-shaped handgrip 13, a framed foot member 14, and a plurality of supporting posts 15. The two crossbars 11 are transversely and fixedly connected to and between the two upright posts 12 to form a frame. An upper one of the two crossbars 11 is located at a height lower than upper ends of the two upright posts 12 by a predetermined distance, allowing the upper ends of the upright posts 12 to form two receiving sleeves for receiving the reduced insertion heads 31 at the two parted lower ends of the side support 3. The lower one of the two crossbars 11 has two reduced outer ends 111 that are sideward projected from the two upright posts 12 by a predetermined length after the lower crossbar 11 is connected to the upright posts 12, so as to respectively engage with one of two ends of each U-shaped tubular base 2. The U-shaped hand grip 13 is pivotally connected at two ends to two near outer ends of the upper crossbar 11. The framed foot member 14 is pivotally turnably connected at predetermined points to two near outer ends of the lower crossbar 11, such that a first part of the framed foot member 14 is located to one side of the lower crossbar 11 while a second part of the framed foot member 14 to the other side of the lower crossbar 11. It is noted the first part of the framed foot member 14 has dimensions corresponding to that of the handgrip 13 connected to the upper crossbar 11 and is located at the same side as that of the handgrip 13 relative to the upright posts 12. The supporting posts 15 are vertically extended between the handgrip 13 and the first part of the framed foot member 14 to indirectly connect them to one another, and are suitably spaced to reinforce a supporting strength of the whole upright assembly 1.

With the above-described structural members, the two upright assemblies 1 are formed into two modularized and collapsible frames. The two side supports 3 may be connected to the two upright assemblies 1 simply by inserting the reduced insertion heads 31 into the receiving sleeves formed at the upper ends of the upright posts 12 to form a vertical framework for supporting the top bar 4 thereon. And, the two U-shaped tubular bases 2 may be easily connected to reduced ends 111 of the lower crossbars 11 to separately locate at front and rear sides of the two upright assemblies 1 to provide the whole vertical framework of the present invention with a horizontally supporting strength. On the other hand, the vertical framework formed from the upright assemblies 1 and the side supports 3 may be easily collapsed, and the horizontally extended bases 2 may also be quickly disassembled from the upright assemblies 1, so that the present invention could be stored in a largely reduced volume.

For the whole erected framework, particularly the upright assemblies 1, of the present invention to have an even more enhanced structural strength and stability for use safely, an auxiliary strut 16 is pivotally connected at a first end to a predetermined position on each upright post 12 by means of, for example, a pin, and at a second end to a position on one of the two U-shaped tubular bases 2, such that the auxiliary strut 16 is diagonally extended between the upright post 12 and the U-shaped tubular base 2.

Moreover, for the modularized upright assemblies 1 to be more perfect for use, a secondary crossbar 17 is additionally provided between two upright posts 12 of each upright assembly 1 to locate at a height the same as that of the first end of the auxiliary struts 16 pivotally connected to the upright post 12. Two receiving brackets 171 are separately connected to two opposite sides of each secondary crossbar 17 near two outer ends thereof, such that each receiving bracket 171 is able to firmly hold the second end of one corresponding auxiliary strut 16 thereto when the latter is disengaged at the second end from the U-shaped tubular base 2 and pivotally turned upward about the first end to finally become parallel with the secondary crossbar 17.

Figure 3:
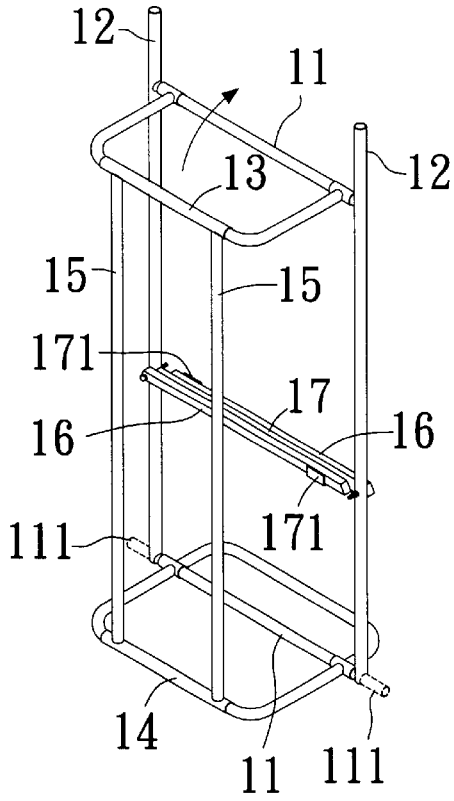
FIG. 3 is a perspective view of an upright assembly of the present invention in an erected state for use.
Figure 4:
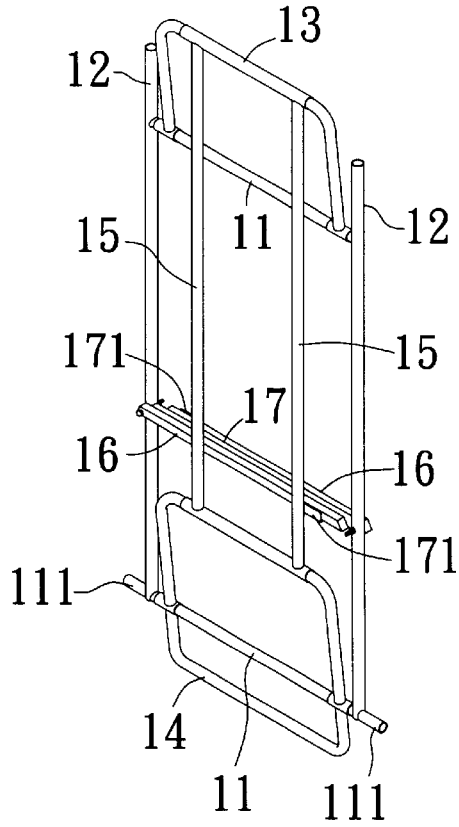
FIG. 4 is a perspective view of the upright assembly of FIG. 3 in a collapsed state for storage.

FIGS. 3 and 4 are perspective views showing the manner of collapsing the upright assembly 1 of the present invention. When it is desired to collapse each upright assembly 1, first disengage the second end of each auxiliary strut 16 from the tubular base 2 and pivotally turn the auxiliary strut 16 about the first end thereof to locate the second end in the corresponding receiving bracket 171 on the secondary crossbar 17. Then, pull the U-shaped handgrip 13 upward, so that the handgrip 13 is pivotally turned upward about the upper crossbar 11 until the handgrip 13, the upper and lower crossbars 11, and the two upright posts 12 are located almost in the same one plane. When the hand grip 13 is pivotally turned upward, the framed foot member 14 indirectly connected to the handgrip 13 via the supporting posts 15 is synchronously turned about the lower crossbar 11 into a position closely attached to the upright posts 12. At this point, the whole upright assembly 1 is collapsed into a flat state and the volume thereof is minimized. Meanwhile, according to the present invention, an overall area of the collapsed upright assembly 1 is almost the same as an overall area occupied by the U-shaped tubular bases 2, the A-shaped side supports 3, and the long top bar 4. Therefore, the present invention in a fully collapsed state has largely reduced dimensions and can be advantageously packed and stored.

To enable all structural members of the present invention to be connect to one another in a more solid and reliable manner, they are correspondingly provided at respective insertion heads and/or receiving sleeves with diametrically extended through holes or threaded holes, through each of which an insertion pin or a threaded bolt may be extended to firmly hold two connected members in place.

The present invention has been described with a preferred embodiment thereof and it is understood that many changes and modifications in the described embodiment can be carried out without departing from the scope and the spirit of the invention as defined by the appended claims.

What is claimed is:

1. A quickly collapsible and erectable horizontal and parallel bars combination, comprising two upright assemblies, two U-shaped tubular bases, two side supports, and a top bar;

each of said two upright assemblies being a modularized structure and including an upper and a lower crossbar, two upright posts, a U-shaped handgrip, a framed foot member, and a plurality of supporting posts; said upper and lower crossbars being fixedly and transversely connected to and extended between predetermined positions on said two upright posts to form a frame, said U-shaped handgrip being pivotally connected at two ends to two outer ends of said upper crossbar, said framed foot member being pivotally connected at two predetermined positions to two outer ends of said lower crossbar for a first and a second part of said framed foot member to separately locate at two opposite sides of said lower crossbar, and said upright posts being spaced from one another by a predetermined distance to vertically extend between and thereby indirectly connect said handgrip to said first part of said framed foot member;

each of said two side supports having lower ends detachably inserted into upper receiving sleeves at upper ends of said two upright posts of each said upright assembly to form a vertical framework;

said top bar being transversely and detachably connected to and supported on two upper ends of said two side supports; and said two U-shaped tubular bases being separately detachably connected to front and rear sides of said two upright assemblies to provide said vertical frameworks formed from said upright assemblies and said side supports with a horizontal supporting strength;

each of said upright assemblies being collapsible into a flat state to have a largely reduce volume simply by pivotally upward turning said handgrip and said framed foot member about said upper and said lower crossbar, respectively; and said whole horizontal and parallel bars combination being collapsible to occupy a largely reduced space for advantageous packing and storage simply by detaching said top bar, said side supports, and said U-shaped tubular bases from said upright assemblies before collapsing said upright assemblies.

2. The quickly collapsible and erectable horizontal and parallel bars combination as claimed in claim 1, wherein said upper crossbar is transversely connected at two outer ends to said two upright posts at positions lower than said two upper receiving sleeves of said upright posts by a predetermined distance.

3. The quickly collapsible and erectable horizontal and parallel bars combination as claimed in claim 1, wherein each of said lower crossbars has two outer ends formed into two reduced insertion heads and sideward projected from said two upright posts by a predetermined length after being connected to said upright posts, so that two receiving ends of each said U-shaped tubular base may be engaged with said projected insertion heads of said lower crossbars to connect the bases to the upright assemblies.

4. The quickly collapsible and erectable horizontal and parallel bars combination as claimed in claim 1, wherein said first part of each said framed foot member and said U-shaped handgrip have the same dimensions and are located at the same side of said two upright posts.

5. The quickly collapsible and erectable horizontal and parallel bars combination as claimed in claim 1, further comprising a plurality of auxiliary struts, each of which being pivotally connected at a first end to a predetermined position of one of said upright posts of said upright assemblies by means of a pin, and detachably connected at a second end to one of said two U-shaped tubular bases, such that each of said struts is diagonally extended between said upright post and said U-shaped base.

6. The quickly collapsible and erectable horizontal and parallel bars combination as claimed in claim 5, further comprising a secondary crossbar transversely extended between said two upright posts of each said upright assembly to located at a predetermined height above said lower crossbar, and two receiving brackets being provided at two opposite sides of each said secondary crossbar near two outer ends thereof; whereby when said auxiliary struts are disengaged at said second ends from said U-shaped tubular bases and pivotally turned upward about said first ends, said second ends of said auxiliary struts may be separately located in said receiving brackets and held thereto.

* * * * *